US009457210B2

(12) United States Patent
Qiang et al.

(10) Patent No.: US 9,457,210 B2
(45) Date of Patent: Oct. 4, 2016

(54) PORTABLE FIRE EXTINGUISHER

(75) Inventors: Jian Qiang, Xi'an (CN); Yanbin Yang, Xi'an (CN); Tao Ji, Xi'an (CN); Zhengjun Lei, Xi'an (CN); Shuixiong Zhu, Xi'an (CN)

(73) Assignee: XI'AN WESTPEACE FIRE TECHNOLOGY CO., LTD, Shaanxi (CN)

( * ) Notice: Subject to any disclaimer, the term of this patent is extended or adjusted under 35 U.S.C. 154(b) by 199 days.

(21) Appl. No.: 14/347,927

(22) PCT Filed: Aug. 16, 2012

(86) PCT No.: PCT/CN2012/080225

§ 371 (c)(1),
(2), (4) Date: Mar. 27, 2014

(87) PCT Pub. No.: WO2013/044699

PCT Pub. Date: Apr. 4, 2013

(65) Prior Publication Data

US 2014/0216766 A1 Aug. 7, 2014

(30) Foreign Application Priority Data

Sep. 28, 2011 (CN) ..... 2011 2 0372449 U

(51) Int. Cl.

| | |
|---|---|
| ***A62C 11/00*** | (2006.01) |
| ***A62C 19/00*** | (2006.01) |
| ***A62C 13/76*** | (2006.01) |

(Continued)

(52) U.S. Cl.

CPC ..... *A62C 19/00* (2013.01); *A62C 5/006* (2013.01); *A62C 13/22* (2013.01); *A62C 13/76* (2013.01)

(58) Field of Classification Search

CPC ..... A62C 13/76; A62C 13/22; A62C 13/64; A62C 5/006; A62C 13/20; A62C 19/00

USPC ..... 169/28, 30, 75, 80

See application file for complete search history.

(56) References Cited

U.S. PATENT DOCUMENTS

| | | | |
|---|---|---|---|
| 1,588,234 | A | 3/1923 | Kauch |
| 2,057,840 | A | 1/1935 | Neumann |

(Continued)

FOREIGN PATENT DOCUMENTS

| | | | |
|---|---|---|---|
| CA | 2758603 | A1 | 8/2011 |
| CN | 2395749 | Y | 9/2000 |

(Continued)

OTHER PUBLICATIONS

International Search Report for corresponding application PCT/CN2012/080226 filed Aug. 16, 2012; Mail date Nov. 15, 2012.

(Continued)

*Primary Examiner* — Jason Boeckmann
(74) *Attorney, Agent, or Firm* — Cantor Colburn LLP

(57) ABSTRACT

A portable fire extinguisher includes a housing (3) and a cartridge (4) arranged within the housing (3). The cartridge (4) is fixedly connected at a bottom thereof to the housing (3) via a fastening device (40). This on the one hand facilitates shifting, and on the other hand allows the cartridge (4) to be fixed appropriately in the housing (3), thus not easily rotated or loosened, also, the need of a production site for waiting for silicone solidification by standing for seven to eight hours is avoided when silicone injection for fixing is used, thus improving production efficiency.

16 Claims, 8 Drawing Sheets

(51) Int. Cl.
*A62C 5/00* (2006.01)
*A62C 13/22* (2006.01)

(56) References Cited

U.S. PATENT DOCUMENTS

| | | | | | |
|---|---|---|---|---|---|
| 2,502,923 | A | | 2/1949 | Burgoyne | |
| 2,960,369 | A | | 8/1958 | Goldie | |
| 2,865,456 | A | * | 12/1958 | Dennis | A62C 13/22 102/531 |
| 4,197,213 | A | * | 4/1980 | Pietz | B01J 7/00 128/202.26 |
| 5,282,541 | A | | 2/1994 | Chen | |
| 5,992,531 | A | | 11/1999 | Mikulec | |
| 8,800,676 | B2 | * | 8/2014 | Guo | A62C 5/006 169/30 |
| 8,844,644 | B2 | | 9/2014 | Guo | |
| 2006/0175067 | A1 | | 8/2006 | Cover | |
| 2011/0155398 | A1 | | 6/2011 | Holland | |
| 2013/0175061 | A1 | | 7/2013 | Guo | |

FOREIGN PATENT DOCUMENTS

| | | | | | |
|---|---|---|---|---|---|
| CN | 1378867 | | 11/2002 | | |
| CN | 201815031 | U | 5/2011 | | |
| CN | WO 2011091652 | A1 | * | 8/2011 | A62C 5/006 |
| CN | 202236978 | U | 5/2012 | | |
| CN | 202236979 | U | 5/2012 | | |
| CN | 202236980 | U | 5/2012 | | |
| CN | 202236991 | U | 5/2012 | | |
| DE | 8900351 | U1 | 3/1989 | | |
| EP | 0693303 | A2 | 1/1996 | | |
| EP | 0750923 | | 1/1997 | | |
| EP | 0750923 | A2 | 1/1997 | | |
| FR | 2647354 | A1 | 11/1990 | | |
| GB | 2190586 | | 11/1987 | | |
| JP | 8252338 | | 10/1996 | | |
| JP | 2011062340 | A | 3/2011 | | |

OTHER PUBLICATIONS

International Search Report for corresponding application PCT/CN2012/080306 filed Aug. 17, 2012; Mail date Nov. 8, 2012.

International Search Report for corresponding application PCT/CN2012/080225 filed Aug. 16, 2012; Mail date Nov. 8, 2012.

European Search Report for corresponding application 12 83 5013.9; Dated May 15, 2015.

European Search Report for corresponding application EP12835355: Report issued Jun. 12, 2015.

* cited by examiner

PORTABLE FIRE EXTINGUISHER

TECHNICAL FIELD OF THE INVENTION

The present disclosure belongs to the field of fire fighting technology, and particularly relating to a portable fire extinguisher.

BACKGROUND OF THE INVENTION

At present, existing portable fire extinguishers are generally divided into stored-pressure dry powder fire extinguishers and portable aerosol fire extinguishers, wherein the stored-pressure dry powder fire extinguisher mainly have the following disadvantages: firstly, the stored-pressure dry powder fire extinguisher causes serious pollution to the environment and serious damage to articles; secondly, the stored-pressure dry powder fire extinguisher, which needs to store high pressure gases, is large in volume and heavy in weight; thirdly, the stored-pressure dry powder fire extinguisher, which is a high pressure container, has potential safety hazards and is more dangerous in a high temperature environment of a fire; fourthly, the stored-pressure dry powder fire extinguisher, which needs to go through regular inspection and verification, is high in routine maintenance costs etc. By contrast, the portable aerosol fire extinguisher has obvious advantages and mainly includes: a cartridge, a cartridge cover arranged on the cartridge, and a pyrotechnic composition, an ignition head, a coolant and a ceramic chip etc. arranged in the cartridge in turn and coated by a heat insulation material. Normally, after the pyrotechnic composition is ignited by the ignition head, a great deal of aerosol smog will be generated by the grain through rapid stratified combustion, and after being cooled by a coolant layer, these high temperature aerosols will be ejected from the cartridge cover of the cartridge to act on a fire source directly, thus extinguishing the fire. However, there are also some disadvantages. A coating defect, a pyrotechnic composition crack or a serious blockage of a gas channel may lead to a sudden rise of the pressure in the cartridge to deflagrate the grain. As a result, a high pressure gas will thrust the cartridge cover forwards and will be vented rapidly to throw the cartridge cover and other things in the cartridge forwards at an extremely high speed, thus causing a very large recoil force. The powerful recoil force drives the cartridge to move backwards rapidly, which is easy to cause an injury to an operator. At the same time, after explosion venting, the cartridge cover etc. of the fire extinguisher will also break away from the cartridge and fly outwards for a relatively long distance, which may cause other accidents. In addition, the cartridge of the fire extinguisher is easy to be loosened in an outer housing and is fixed by filling silicone in the cartridge body currently. However, the method generally needs to wait for silicone solidification by standing for seven to eight hours after silicone injection, thus a relatively large production site is required and the production efficiency is relatively low. Therefore, the problem of fixation of the cartridge of the fire extinguisher is a subject to be solved.

SUMMARY OF THE INVENTION

To solve disadvantages existing in a portable fire extinguisher in the prior art, the present disclosure provides a simple and convenient portable fire extinguisher capable of greatly reducing a production site and effectively preventing explosion and releasing pressure, and reducing a recoil force.

The technical solution adopted by the present disclosure to solve the technical problem above is:

A portable fire extinguisher includes a housing and a cartridge arranged within the housing; the top of the cartridge is provided with a cartridge cover, wherein a bottom of the cartridge is fixedly connected to the housing via a fastening device. This on the one hand facilitates shifting, and on the other hand allows the cartridge to be fixed appropriately in the housing, thus not easily rotated or loosened, also, the need of a production site for waiting for silicone solidification by standing for seven to eight hours is avoided when silicone injection for fixing is used, thus improving production efficiency.

The fastening device of the present disclosure mainly includes a screw provided at the bottom of the cartridge, a nut matched with the screw and a rotation-stopping body provided at the bottom of the housing and capable of preventing the screw from rotating.

The fastening device of the present disclosure may be also a screw running through the bottom of the housing to fixedly connect the housing with the bottom of the cartridge.

A top end of the cartridge of the present disclosure is provided with an explosion venting device; the explosion venting device includes a frictional layer, a connection rod, a connection rod guiding unit and a connection rod limiting device, wherein the connection rod is connected with the cartridge cover; the frictional layer is provided between the connection rod and an outer wall of the cartridge; when the connection rod is guided by the connection rod guiding unit to displace along a direction of a hot air stream ejected by the cartridge, the frictional layer provides a frictional resistance and a buffering force for the connection rod; the connection rod guiding unit is a device capable of providing a guiding function for the connection rod when the same is moving; the connection rod limiting device is a device capable of limiting the connection rod when an extremity of the connection rod reaches an spout of the cartridge. By consuming, in a shifting and limiting process of the explosion-venting device, kinetic energy generated by deflagration, a recoil force or a forward impact force generated after deflagration of an explosive can be consumed or reduced to vent explosion safely and effectively and avoid injuries or damages caused after deflagration of the cartridge.

The connection rod guiding unit is a guiding ring fixedly connected with the connection rod, or is a guiding groove provided on the outer wall of the cartridge and capable of enabling the connection rod to move axially along the guiding groove; the connection rod limiting device includes a flanging fixedly connected with a jet end of the cartridge and a clamping claw for fixing the connection rod; an elastic body is arranged between the flanging and the connection rod guiding unit, or is arranged on a side surface of the flanging.

The housing of the present disclosure includes a top cover; the top cover includes a top cover body and a clamping wall fixedly connected thereto; the clamping wall is arranged at an inner side of the top cover body and an extremity of the clamping wall is provided with a clamping hook, and a cavity is reserved between the clamping hook and the top cover body; a fixture block is arranged in the cavity between the clamping wall and the top cover body; the cartridge and the fixture block are respectively clamped at two sides of the clamping wall to effectively prevent deformation thereof and prevent the cartridge from being loosened by the deformation of the clamping wall of the top cover.

The bottom of the housing of the present disclosure is provided with a base with a handle and an extension and retraction control device provided thereon; extension and retraction of the handle are implemented through the extension and retraction control device, thus further saving storage space to facilitate operation and facilitating transportation and storage.

The extension and retraction control device mainly includes a locating groove arranged on the base and capable of enabling the handle to slide along the locating groove, and a limiting device capable of limiting the sliding of the handle. Limited by the locating groove, offsetting and locking during an extension and retraction process are prevented, and the limiting device performs limiting control for extension and retraction of the handle.

The limiting device mainly includes a limiting elastic sheet, a limiting screw and a limiting groove; the limiting elastic sheet is arranged in the locating groove; one side surface of the handle is provided with the limiting screw clamped with the base and the other side surface of the handle (10) is provided with the limiting groove for making the limiting elastic sheet locked; a bottom cover of the base is provided thereon with a chute capable of enabling the limiting screw to slide along the chute and capable of limiting the limiting screw.

The handle includes a curved bar and a holder; the curved bar is arranged in the locating groove and capable of sliding along the locating groove; the holder is arranged at an extremity of the curved bar.

A cavity may be arranged on both the curved bar and the holder; a push button and piezoelectric ceramics are arranged in the holder in turn; one end of the push button extends outside the holder and the other end is provided with a pin hole; an elastic clamping claw and a convex ring are arranged on the pin hole; the outer wall of the handle is provided with a safety pin; a side wall of one end of the safety pin is provided with a concave ring locked with the convex ring and an extremity of the safety pin extends into the pin hole to be locked and tightly clamped with the convex ring through the elastic clamping claw and the concave ring to fasten the safety pin; the other end of the safety pin is provided with a pull ring so that the pull ring can be pulled out.

The curved bar and the holder are hollow structures; a push button and a piezoelectric ceramics are arranged in the holder in turn; one end of the push button (33) extends outside the holder (32) and the other end is provided with a pin hole; a limiting ring is arranged outside the pin hole; an outer wall of the holder is provided with a safety pin; the safety pin includes a connection part and a clamping head connected to the lower end of the connection part; the clamping head includes one or more first elastic sheets and a second elastic sheet connected to extremity of the first elastic sheet and forming included angle with the first elastic sheets; the first elastic sheet and the second elastic sheet are respectively provided with degrees of freedom; an extremity of the second elastic sheet extends outside the pin hole and is limited through the limiting ring; the upper end of the connection part is provided with a pull ring.

The portable fire extinguisher of the present disclosure mainly has the following advantages:

1. the cartridge of the present disclosure is fixed in the housing through the fastening device, which on the one hand facilitates installation, and on the other hand allows the cartridge to be fixed properly in the housing, thus not easily being rotated or loosened; and the need of a production site for waiting for silicone solidification by standing for seven to eight hours is avoided when silicone injection for fixing is used, thus improving production efficiency.

2. the fire extinguisher of the present disclosure is provided with the explosion venting device on the cartridge, thus consuming or reducing a recoil force or a forward impact force generated by deflagration of an explosive to vent explosion safely and effectively and avoid injuries and damages caused after deflagration of the cartridge mainly through consuming kinetic energy generated by the deflagration in a shifting and limiting process of the explosion venting device; the aim of a forward movement is to release pressure while the aim of limited displacement and final limiting are to reduce the recoil force.

3. the connection rod of the present disclosure is connected with the cartridge cover of the cartridge, and adopts a structure of a flanging and a clamping claw, thus effectively controlling a motion of the connection rod, and the structure can effectively prevent a powerful impact force from acting on the cartridge cover of the cartridge to thrust the cartridge cover apart from the cartridge so as to prevent accidental injuries caused after the cartridge cover flies outwards;

4. the present disclosure mainly adopts filling the fixture block in the cavity between the clamping wall of the top cover and the top cover body so that the inner and outer sides of the clamping wall are fully filled; the cartridge is provided at the inner side and the fixture block is provided at the outer side, thus ensuring that the clamping wall will not deform, so that a relatively large extrusion force and axial tensioning force can be born so as to ensure that the cartridge can be clamped tightly; in addition, the present disclosure is simple in structure and convenient in installation.

5. the present disclosure is provided with a telescopic handle, which is convenient in packaging and transportation and saves storage space; more specifically, by the locating groove and the limiting elastic sheet arranged on the base and the limiting screw on the handle and so on, it can be ensured that the handle can be fixed and will not be separated from the housing after being pulled out, and problems of offsetting and locking dead can be also avoided;

6. the safety pin of the present disclosure is clamped tightly through the concave ring provided on the side wall of the safety pin and the elastic clamping claw on the pin hole, or is locked safely through a connection head provided on an extremity of the safety pin and capable of being limited by the limiting ring on the pin hole, thus the safety pin will not fall off easily so as to avoid the danger of error starting; in addition, the safety pin may be utilized repeatedly.

Figure 1:
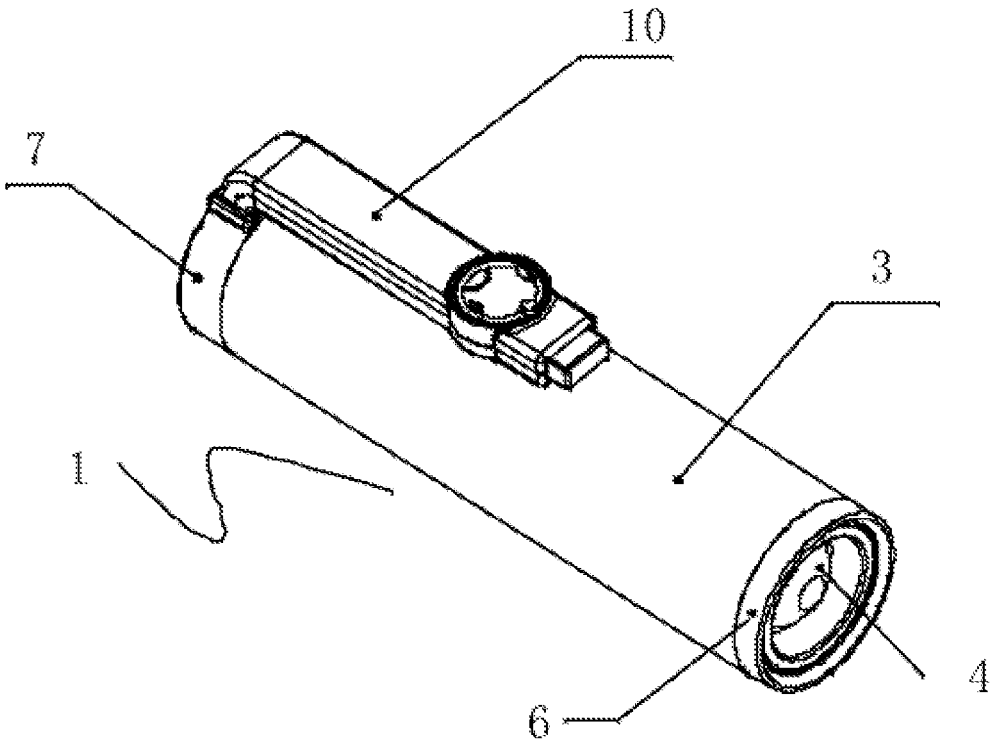
FIG. 1 is a structural diagram of a fire extinguisher of the present disclosure.

In the drawings: 1—fire extinguisher, 2—explosion venting device, 3—housing, 4—cartridge, 5—cartridge cover, 6—top cover, 7—base, 8—base body, 9—bottom cover, 10—handle, 11—frictional layer, 12—connection rod, 13—connection rod guiding unit, 14—connection rod limiting device, 15—guiding ring, 16—flanging, 17—clamping claw, 18—elastic body, 19—top cover body, 20—clamping wall, 21—clamping hook, 22—fixture block, 23—clamping point, 24—extension and retraction control device, 25—locating groove, 26—limiting elastic sheet, 27—limiting screw, 28—limiting groove, 29—limiting device, 30—starting device, 31—curved bar, 32—holder, 33—push button, 34—piezoelectric ceramics, 35—pin hole, 36—elastic clamping claw, 37—safety pin, 38—pull ring, 39—chute, 40—fastening device, 41—screw, 42—rotation-stopping body, 43—bump, 44—connection part, 45—clamping head, 46—first elastic sheet, 48—concave ring.

DETAILED DESCRIPTION OF THE EMBODIMENTS

The present disclosure provides a portable fire extinguisher, and preferred embodiments of the present disclosure will be further described in combination with the accompanying drawings.

Figure 2:
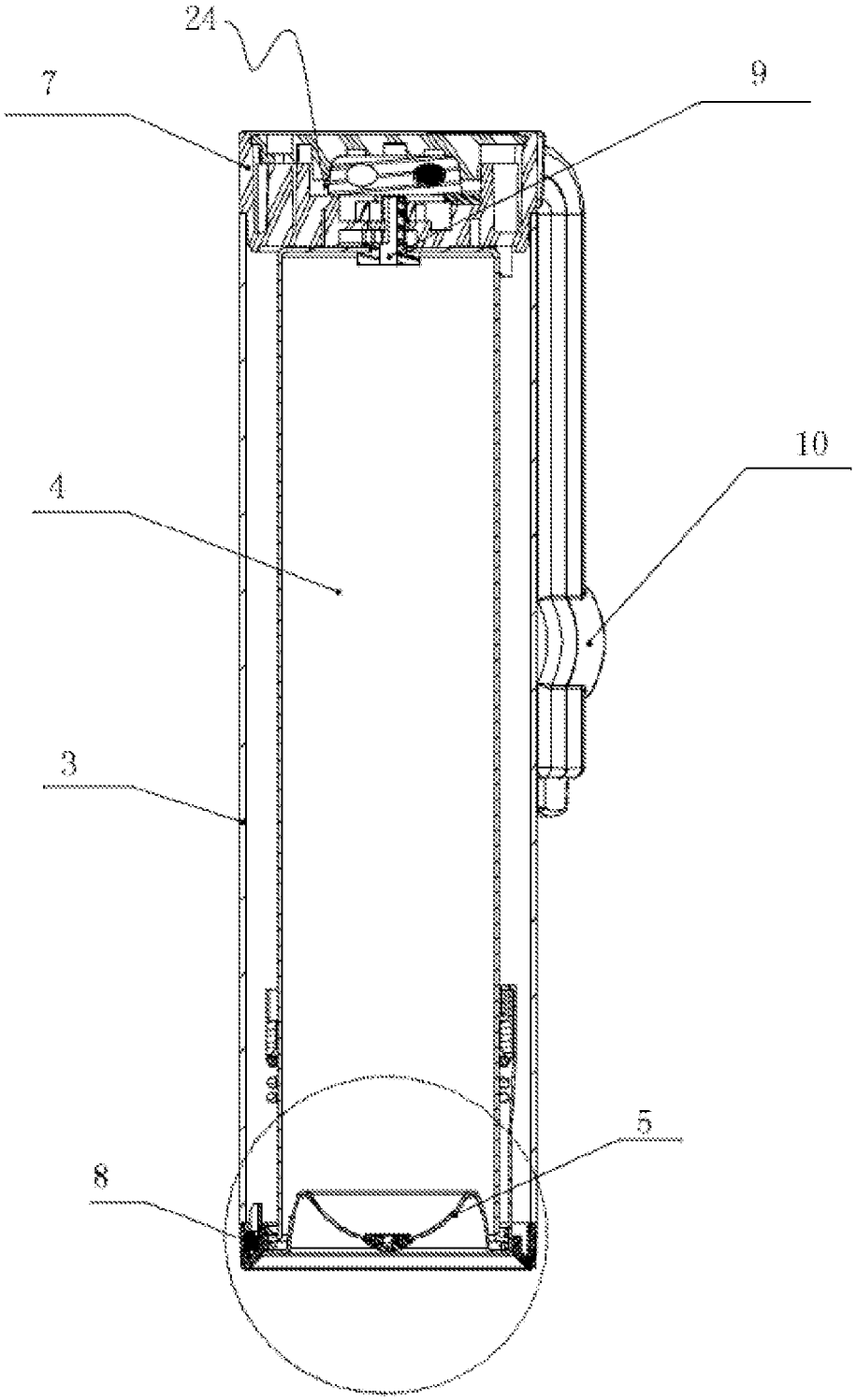
FIG. 2 is a sectional view of a structure of a fire extinguisher of the present disclosure.

Referring to FIG. 1 and FIG. 2, the fire extinguisher 1 mainly consists of a housing 3, a base 7 and a top cover 6 of the housing 3, a cartridge 4, a cartridge cover 5, an explosion venting device 2 and a handle 10, wherein the housing 3 is a columnar structure, such as a cylindrical structure, a square columnar structure or an irregular columnar structure etc. and adopts a extruded aluminium material with good cooling effect; the top cover 6 and the base 7 of the housing 3 are arranged at two ends of the housing 3, respectively, and connection parts with the housing 3 can extend into a cavity of the housing 3.

Figure 3:
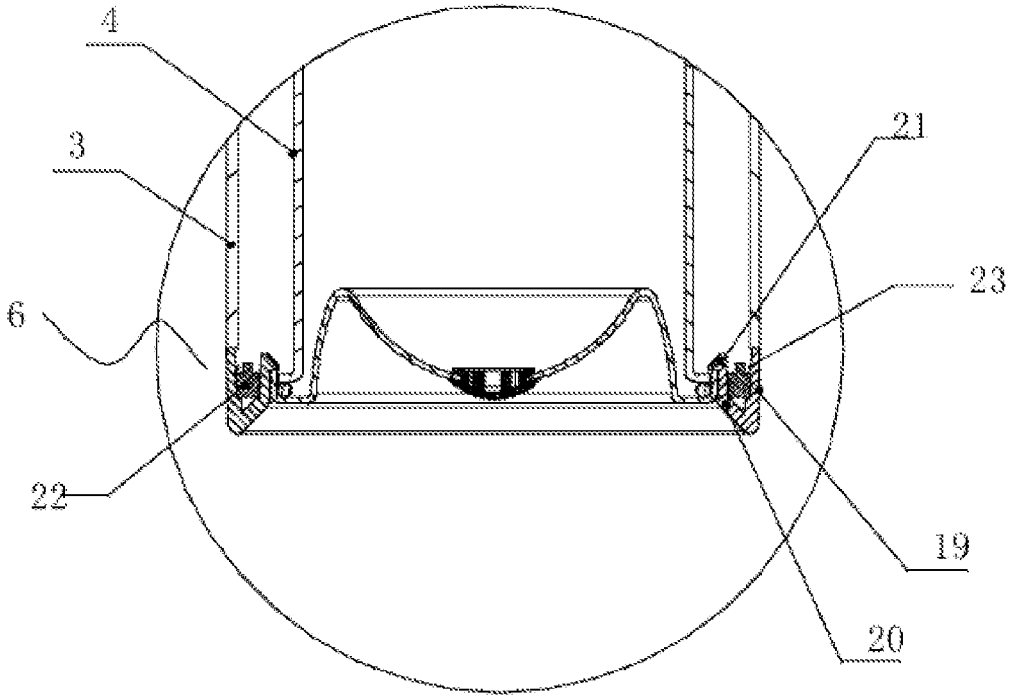
FIG. 3 is a partial enlarged drawing of FIG. 2.

Referring to FIG. 3, the top cover 6 mainly consists of a clamping wall 20 and a top cover body 19, wherein the clamping wall 20 is fixedly connected with the top cover body 19 and is arranged between an inner side of the top cover body 19 and the top cover body 19 to form a cavity; an extremity of the clamping wall 20 is provided with a clamping hook 21 capable of clamping the cartridge cover 5 of the cartridge 4 tightly to prevent axial detachment of the cartridge cover; the top cover body 19 is connected with the wall of the housing 3; a cavity between the clamping wall 20 and the top cover body 19 is provided therein with a fixture block 22 having a structure matched with the cavity to fully fill the cavity, and one or more clamping points 23 capable of clamping the fixture block 22 and capable of preventing the fixture block 22 from being detached may be provided on the clamping wall 20 and the top cover body 19.

During installation, the cartridge 4 is clamped on the top cover 6 first, and the fixture block 22 is then stuck into the cavity between the clamping wall 20 and the top cover body 19 and the fixture block 22 is tightly clamped by convex points; an extremity of the cartridge 4 is then put into the housing 3 and the top cover 6 is secured to complete the installation.

Figure 4:
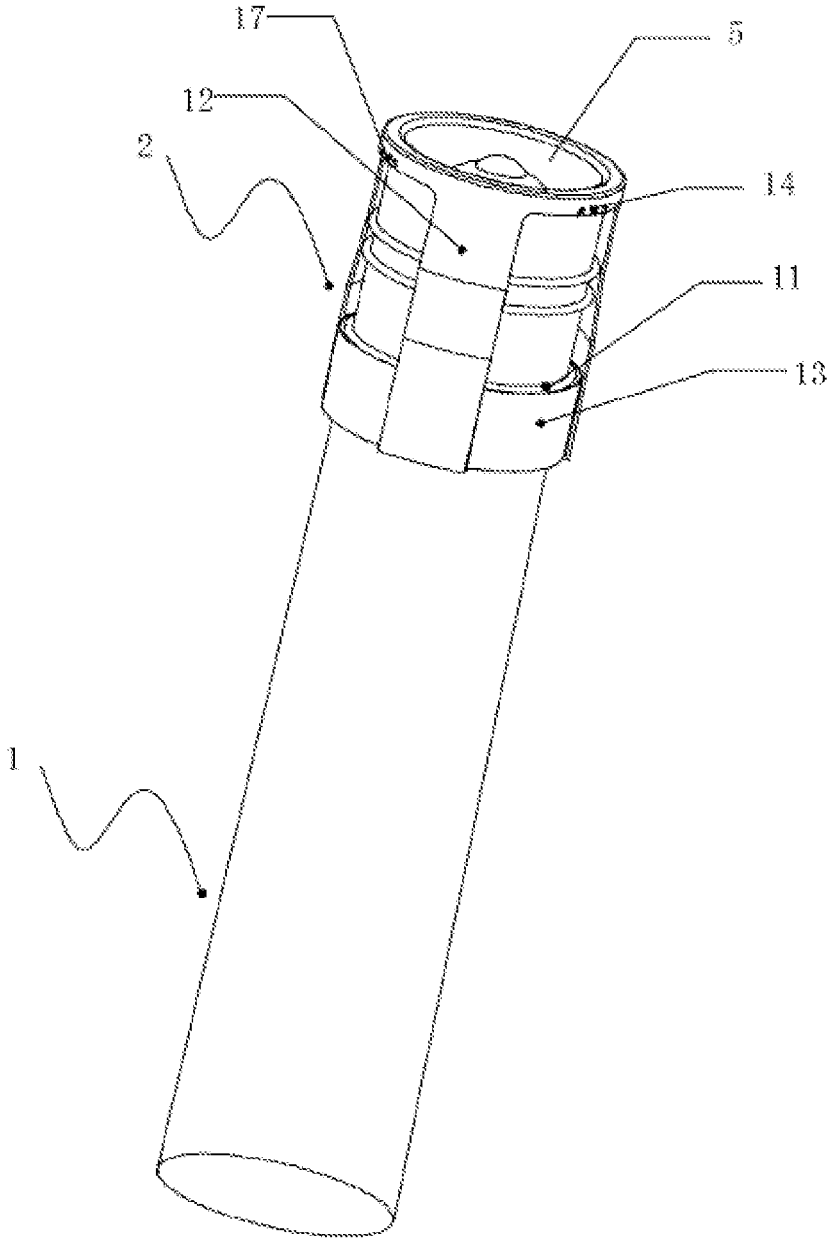
FIG. 4 is a structural diagram of a cartridge of the present disclosure.
Figure 5:
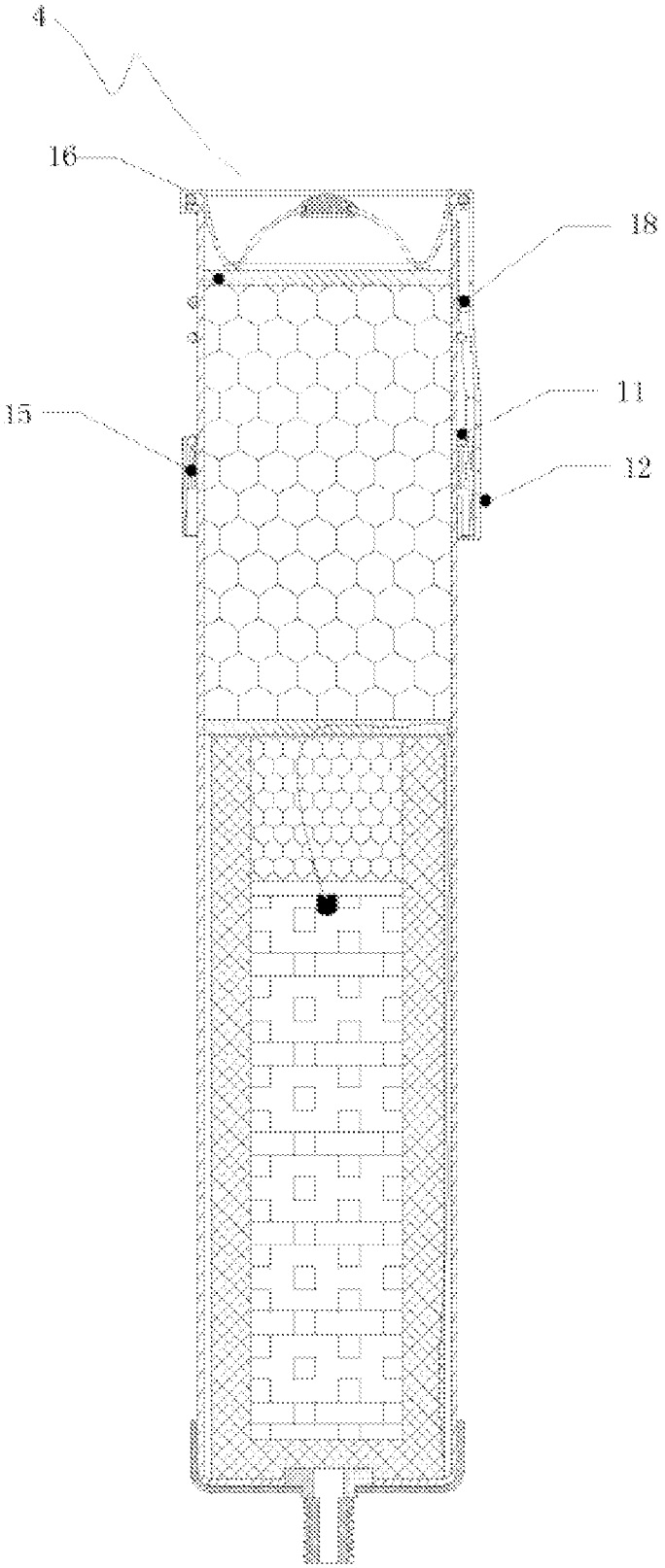
FIG. 5 is a sectional view of a structure of a cartridge of the present disclosure.

Referring to FIG. 4 and FIG. 5, a top end of the cartridge 4 is further provided with the cartridge cover 5 of the cartridge 4; a ceramic cellular cooling layer, a coolant, gain and an ignition head arranged on the section of the front end of the gain are arranged in the cartridge 4 in turn; generally, the cartridge 4 and the cartridge cover 5 of the cartridge 4 are connected hermetically by a sealing ring, wherein the section of the sealing ring may be square, or may be also circular or in other shapes; the cartridge cover 5 of the cartridge 4 includes a spout and a trumpet nozzle, and the center of the spout faces the center of the trumpet nozzle; the spout may be sealed by a rubber plug or an aluminium foil; in addition, the ceramic cellular cooling layer can on one hand fix the coolant to prevent the coolant from dropping out, and on the other hand have a physical cooling effect to reduce the temperature of a high temperature hot aerosol; generally, the ceramic cellular cooling layer may be arranged at the front end of the coolant, or may be provided in the middle of the coolant, or may be also provided at both the front end and the middle section of the coolant, and the positions and quantity of ceramic cellular cooling layers are determined according to actual application conditions; one end of the trumpet nozzle with a relatively large diameter of the present disclosure may be connected with the cellular cooling layer, thus guiding an aerosol to be ejected from the spout, and the trumpet nozzle may be integrated with the cartridge cover 5; a heat insulation layer may be further added between the grain and the inner wall of the cartridge 4 to have a heat insulation effect and prevent people or materials from being burnt by heat generated after ignition of the aerosol.

The explosion venting device of the present disclosure mainly includes a frictional layer 11, a connection rod 12, a connection rod guiding unit 13, a connection rod limiting device 14 and an elastic body 18, wherein the connection rod 12 is connected on the cartridge cover 5 of the cartridge 4, and may be fixedly connected with the cartridge cover 5 through welding and pivoting etc., or may be also integrated directly with the cartridge cover 5, thus the structural strength is higher; the frictional layer 11 may be one or more rubber rings or silicone layers or other materials capable of providing enough frictional resistance for axial sliding of the connection rod 12; the frictional layer 11 may be arranged between the connection rod 12 and the cartridge 4, or may be directly fixed at an inner side of the connection rod 12; when the connection rod 12 is guided by the connection rod guiding unit 13 to displace along an axial direction of the cartridge 4, the frictional layer 11 provides a frictional resistance and a buffering force for the connection rod; the connection rod guiding unit 13 is a device capable of providing a guiding function for the connection rod 12 when the connection rod 12 is moving, and may be a guiding ring 15 fixedly connected with the connection rod 12, or may be also a guiding groove provided on an outer wall of the cartridge 4 and capable of enabling the connection rod 12 to move axially along the guiding groove, or other structures having a guiding function; this guiding structure can prevent the connection rod 12 from being offset or clamped during a moving process of the cartridge 4; when the guiding ring 15 is applied to guiding, the guiding ring 15 may be fixedly connected or directly integrated with an extremity of the connection rod 12; the connection rod limiting device 14 of the present disclosure is fixedly connected with the cartridge cover 5 of the cartridge 4 and the connection rod 12; when the extremity of the connection rod 12 reaches a position as illustrated of the cartridge cover 5 of the cartridge 4, the connection rod is limited by the connection rod limiting device 14; the connection rod limiting device 14 mainly includes a flanging 16 and a clamping claw 17, wherein the flanging 16 is fixedly connected with the cartridge 4, or may be also integrated directly with the cartridge 4, and one end of the clamping claw 17 is fixed on the connection rod 12 while the other end of the clamping claw 17 is clamped with the cartridge 4 to mainly fix the connection rod 12; the connection rod 12 may be also integrated with the clamping claw 17, or the connection rod limiting device 14 of the present disclosure may be also other structures, as long as the connection rod 12 can be fixed on one hand, and the connection rod 12 can be blocked and prevented from being detached from the cartridge 4 on the other hand. The elastic body 18 may be further arranged between the flanging 16 of the present disclosure and the connection rod guiding unit 13, or may be arranged on a side surface of the flanging 16 to mainly buffer a collision force between the extremity of the connection rod 12 and the cartridge 4 or between the extremity of the connection rod 12 and the flanging 16, prolong collision time and release, by using the elastic property of the elastic body, a part of kinetic energy generated after deflagration.

The displacement of the connection rod 12 of the present disclosure is preferably controlled within a range of 50 to 60 mm, because excessive displacement will fail to reduce a recoil force; however, the kinetic energy cannot be consumed thoroughly by little displacement, and the cartridge cover 5 of the cartridge 4 is very likely to get rid of the blockage of the connection rod limiting device 14; once the cartridge cover 5 of the cartridge 4 is separated from the cartridge 4, a powerful recoil force will be generated; however, the displacement of the connection rod 12 may be adjusted appropriately according to a specific application environment, as long as an optimal explosion venting effect can be realized.

When the gain 7 of an inner cartridge is ignited and released normally, hot air is released from the spout of the cartridge cover 5 of the cartridge 4, and an oversize air stream will not be generated, thus the explosion venting device 2 will not be started; the connection rod 12, which is fixed on the cartridge 4 by the clamping claw 17, will not move to generate displacement along an axial direction of the cartridge 4; only when the cartridge cover 5 of the cartridge 4 and the connection rod 12 are pushed by a powerful hot air stream generated by unexpected explosive deflagration to move in a direction towards which the hot air stream is ejected, the clamping claw 17 of the connection rod limiting device 14 slips off under the action of a powerful impact force on one hand to consume a part of the impact kinetic energy. Pushed by the hot air stream, the connection rod 12 drives the guiding ring 15 to slide axially along the outer wall of the cartridge 4 to generate displacement, and the frictional layer 11 generates frictional resistance to the connection rod during the moving process to consume a part of the impact kinetic energy. When the extremity of the connection rod 12 reaches the spout of the cartridge 4, the flanging 16 of the connection rod limiting device 14 fixed on the cartridge 4 stops the extremity of the connection rod 12 from being separated from the cartridge 4; at the moment, the elastic body 18 arranged between the flanging 16 and the guiding ring 15 functions to consume a part of the impact kinetic energy by its elasticity, and buffers the powerful impact force between the extremity of the connection rod 12 and the flanging 16 additionally. When the final kinetic energy acts on the flanging 16 in the form of collision, the flanging 16 is deformed elastically or plastically, which will consume all remaining kinetic energy. Thus the powerful impact kinetic energy generated by deflagration of the grain 7 may be well consumed or dispersed in the whole process to avoid injuries or damages brought thereby.

Figure 6:
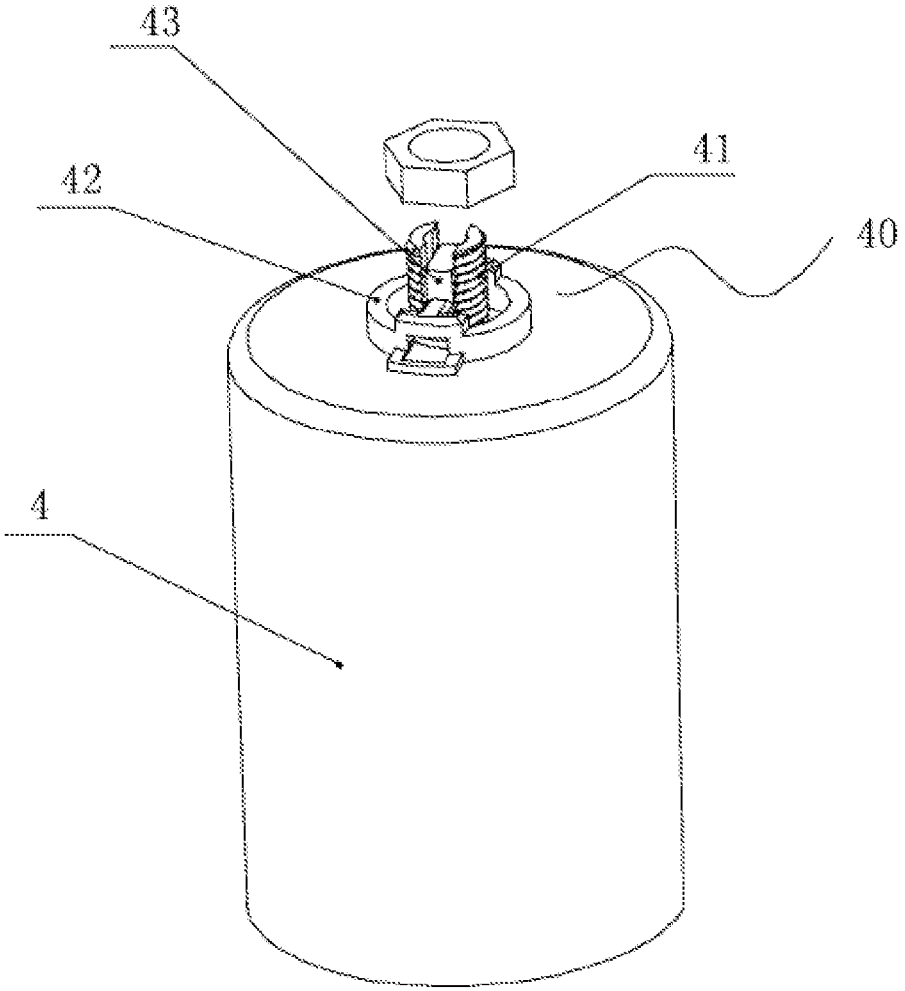
FIG. 6 is a schematic diagram of an embodiment of a fastening device of the present disclosure.
Figure 7:
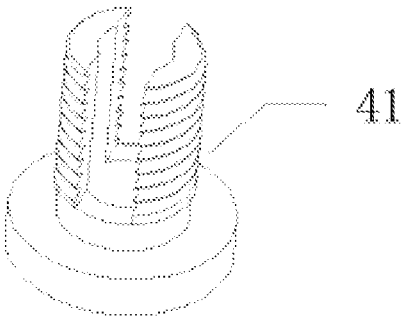
FIG. 7 is a structural diagram of a screw of the present disclosure.
Figure 8:
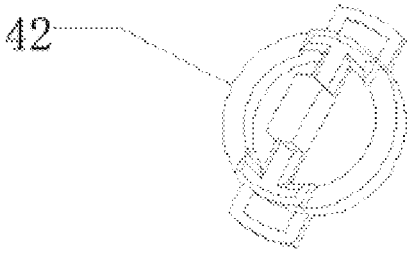
FIG. 8 is a structural diagram of a rotation-stopping body of the present disclosure.

Referring to FIG. 6, FIG. 7 and FIG. 8, a bottom of the cartridge 4 of the present disclosure is fixedly connected with the housing 3 through a fastening device 40; the base 7 of the present disclosure mainly includes a base body 8 and a bottom cover 9 arranged outside the base body 8. The fastening device 40 may be implemented in various ways; in the present embodiment, the fastening device mainly includes a screw 41, a nut matched with the screw 41 and a rotation-stopping body 42 capable of preventing the screw 41 from rotating. The rotation-stopping body 42 may be directly integrated with the base body 8 or may be provided separately and fixed on the base body 8. A bump 43 is arranged on the rotation-stopping body 42, and is directly arranged on the base body 8 and locked with a groove on the screw 41 when integrated with the base body 8. The screw 41 is fixedly connected with the bottom of the cartridge 4, and may be fixed on the bottom of the cartridge 4 through welding, or may also run through and be fixed with the bottom of the cartridge 4 from inside to outside, and is axially provided with a through groove to be fitted with the bump 43. A threaded hole corresponding with the screw 41 is provided on the base 7 of the housing 3 of the present disclosure; the bump 43 is provided on the threaded hole and matched with the structure of the screw 41 so that the bump 43 may be embedded into the through groove of the screw 41, while the screw 41 runs through the rotation-stopping body 42 and extends outside the threaded hole, and assembly can be finished after the nut is tightened. When the nut is tightened, the threaded hole locks the rotation-stopping body 42 to prevent the rotation-stopping body 42 from rotating, while the bump 43 embedded into the through groove of the screw 41 is limited by the rotation-stopping body 42, namely the base body 8 in the present embodiment and will not rotate, thus blocking the screw 41 from rotating. The nut is tightened, and the cartridge 4 is fixed with the housing 3. A bump may be also provided on the side wall of the screw 41 and a groove may be provided on the side wall of the rotation-stopping body 42, and so on, and any structure may be applied as long as the rotation-stopping body 42 is enabled to stop the screw 41 from rotating.

Figure 9:
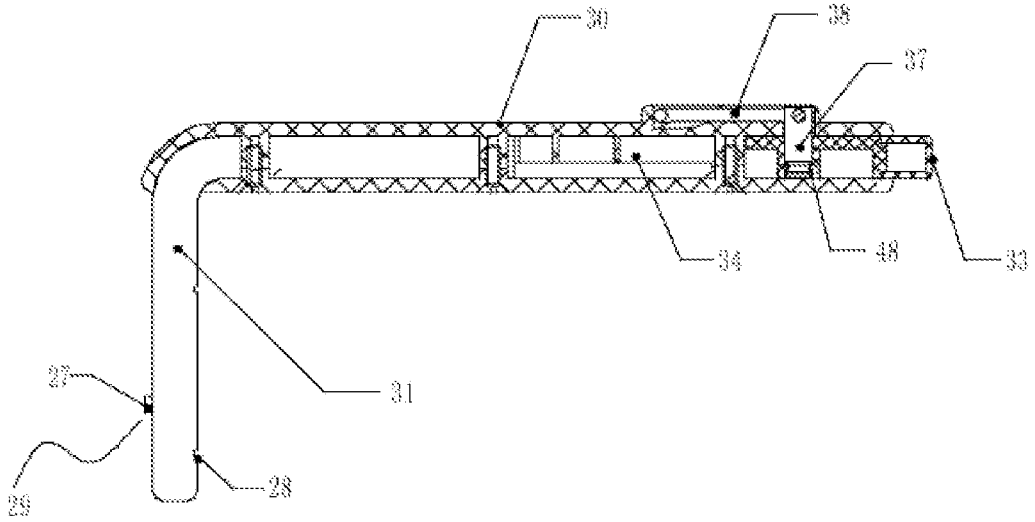
FIG. 9 is a sectional view of a structure of a handle of the present disclosure.
Figure 11:
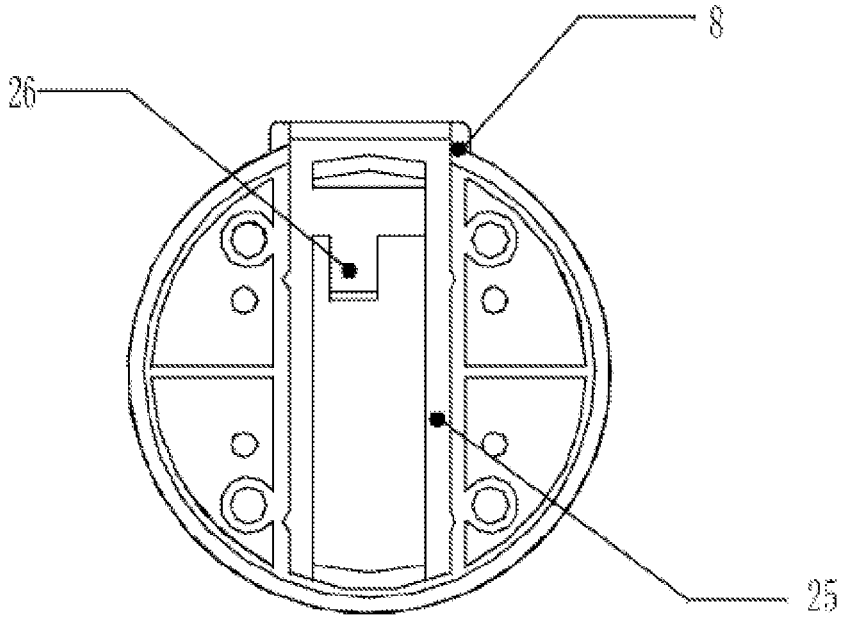
FIG. 11 is a structural diagram of a base of the present disclosure.
Figure 12:
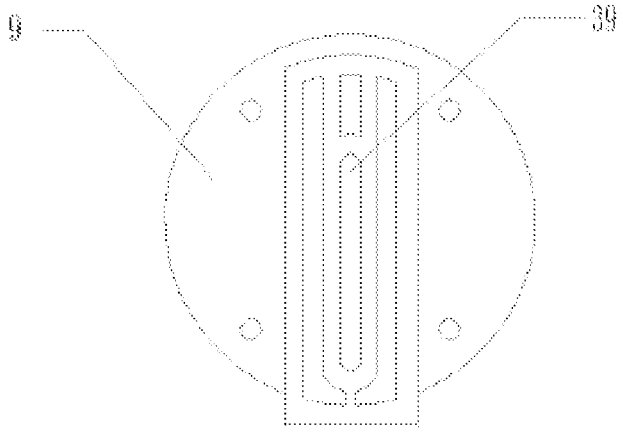
FIG. 12 is a structural diagram of a bottom cover of the present disclosure.

A handle 10 is further arranged on the base 7 of the present disclosure; the handle 10 may have a structure of a handle 10 in the prior art, or may be also a handle 10 with another structure, mainly aiming at facilitating carrying and operation. Referring to FIG. 9, FIG. 11 and FIG. 12, the handle 10 of the present embodiment may adopt a telescopic handle 10, wherein the handle 10 mainly consists of a curved bar 31 and a holder 32, and is fixedly connected through a screw, sleeving, clamping or other ways. The curved bar 31 may adopt a metal material, may be moulded through injection, or may be manufactured through other processes. The holder 32 may be a plastic material, and the plastic material may be also replaced by other material, and the material is not limited thereto and may be determined according to a specific application environment. When extending and retracting, it is mainly that one end of the curved bar 31 extends into the base body 8, and extends and retracts on the base body 8, i.e. the handle 10 extends and retracts on the base 7 mainly through an extension and retraction control device. The extension and retraction control device mainly includes a locating groove 25 and a limiting device 29. The locating groove 25 is arranged on the base body 8 so that the curved bar 31 can slide along the locating groove. The limiting device 29 mainly consists of a limiting elastic sheet 26, a limiting screw 27 and a limiting groove 28, and mainly aims at having a limiting and controlling function during an extension and retraction process of the curved bar 31. The limiting elastic sheet 26, which is arranged in the locating groove 25, may be integrated with the locating groove 25, or may be also an independent detachable component, and mainly needs to provide certain elasticity. The limiting elastic sheet will not limit the sliding of the curved bar 31 when the curved bar 31 is sliding. However, when the curved bar 31 slides to a certain position and needs to be located, the limiting elastic sheet is reset by the elasticity thereof so as to be locked with the limiting groove 28 provided on a corresponding position on the curved bar 31 to limit the curved bar 31. The limiting screw 27 is provided on a side surface of the curved bar 31 opposite to the limiting groove 28; the limiting screw 27 is matched with a chute 39 arranged on the bottom cover 9 of the base 7. When the curved bar 31 slides, the limiting screw 27 will slide along the chute 39 and will not generate offsetting. When the curved bar 31 slides to a predetermined displacement, the limiting screw 27 will be jammed in the chute 39 to prevent the curved bar 31 from being separated from the base body 8. In this way, both sides of the curved bar 31 are limited, so that the curved bar is located precisely and will not be detached or offset and so on.

The curved bar 31 and the holder 32 of the present disclosure are arranged with cavities, so it is beautiful in appearance and saves wiring space. However, grooves or U-shaped grooves and so on may be also provided therewith.

Figure 10:
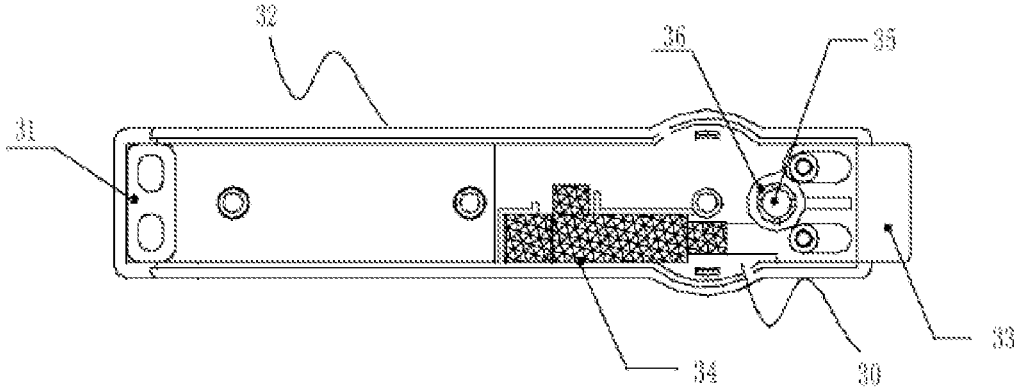
FIG. 10 is a structural diagram of a holder of the present disclosure.

Referring to FIG. 10, a starting device 30 is arranged in the holder 32 of the present disclosure, i.e. a push button 33 and piezoelectric ceramics 34 arranged in turn. One end of the push button 33 extends outside the holder 32 and the other end thereof faces a trigger end of the piezoelectric ceramics 34. One end of the push button 33 facing the piezoelectric ceramics 34 is further provided with a pin hole 35 to install a safety pin 37 so as to prevent the push button 33 from being started by mistake. At the same time, the pin hole 35 further needs to limit the safety pin 37 to prevent the safety pin from being easily loosened or detached. The safety pin 37 of the present disclosure is arranged on the holder 32; one end of the safety pin is provided with a pull ring 38 and exposed out of the holder 32, and the other end extends into the pin hole 35; in addition. The side wall of the other end is provided with a concave ring 48, and a convex ring is provided at a corresponding position of the pin hole 35, and the concave ring and the convex ring are locked with each other. In addition, an elastic clamping claw 36 is arranged at the opening of the pin hole 35, and right clamps an extremity of the safety pin 37 so that the safety pin 37 inserted into the pin hole 35 can be well secured and will not be detached easily. The safety pin 37 can be pulled out only with an external force that is large enough.

Figure 13:
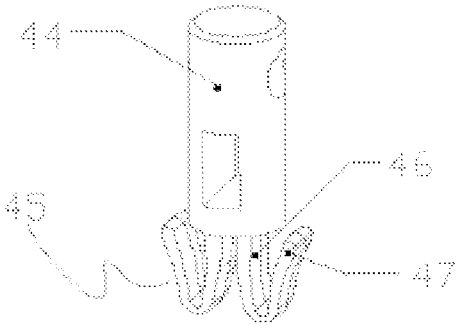
FIG. 13 is a structural diagram of an optimal embodiment of a safety pin of the present disclosure.

The safety pin 37 of the present disclosure may be also of a structure as shown in FIG. 13, and mainly includes a connection part 44, a clamping head 45, and the pull ring 38, wherein the pull ring 38 is provided at the upper end of the connection part 44. The pull ring 38 may be fixedly connected and integrated with the connection part 44, or run through a through hole provided on the connection part 4. The main function of the pull ring 38 is that, when detachment is required, the pull ring 38 is pulled to transmit a force to the connection part 44 and the clamping head 45 to implement detachment. If detachment is not required, it is unnecessary to provide pull ring 38. A middle section of the connection part 44 is provided with a reducing hole so that the wall thickness thereof is uniform and shrinkage can be prevented. The clamping head 45 is provided at the lower end of the connection part 44, and they may be manufactured separately and finally combined through methods including injection and filling, adhesion, interference fit, screw fastening, connection with a connection pin, ultrasonic welding, clamping with plastic clamping hook etc., or may be directly integrated. The clamping head 45 of the present disclosure includes a first elastic sheet 46 and a second elastic sheet 47 connected to an extremity of the first elastic sheet 46, wherein there is a certain included angle between the first elastic sheet 46 and the second elastic sheet 47, i.e. the first elastic sheet and the second elastic sheet are connected in a cross manner to form a "V" shape, an "L" shape or a "J" shape etc. The included angle therebetween needs to be adjusted according to actual application conditions. The first elastic sheet 46 and the second elastic sheet 47 are provided with a degree of freedom, respectively, and may be deformed according to directions of their respective degrees of freedom when an external force is too large. A structure formed by the first elastic sheet 46 and the second elastic sheet 47 is applicable to implement two degrees of freedom as long as a certain tensile force can be overcome to implement a "clamping" function on one hand, and on the other hand, the structure can be stretched and straightened when the tensile force is too large and exceeds the endurance thereof. The wall thickness of the upper end of the first elastic sheet 46 is larger than the wall thickness of the lower end, while the second elastic sheet 47 may be also adjusted according to use conditions and the thickness thereof is not unique. There may be one or two or more clamping heads 45. When there is a plurality of clamping heads, the clamping heads are optimally distributed at the lower end of the connection part 44 in a uniform manner. When there is an even number of clamping heads, the clamping heads are provided symmetrically and may be arranged into a matrix, arranged circumferentially or arranged into a curve, which needs to be determined according to an application environment. A limiting ring is provided out of the opening of the pin hole 35. After the safety pin 37 is inserted, the extremity of the second elastic sheet 47 is right clamped at the opening of the pin hole 35 and limited by the limiting ring so that it is not easily deformed or offset when pulled out.

In order to improve the durability of the clamping head 45, the clamping head 45 is optimally made of an injection material, i.e. a Polyamide material (PA66), PE, PP, ABS, PC or a PC alloy etc., preferably the Polyamide 66 material (PA66). The connection part 44 and the clamping head 45 may adopt the same material, i.e. both of them adopt the injection material Polyamide 66 material (PA66), thus improving the abrasive resistance, the tensile resistance and the number of recycling times thereof.

In normal conditions of the portable fire extinguisher of the present disclosure, the safety pin 37 should be clamped in the pin hole 35, tightly; the push button 33 is fixed by the pin hole 35 and cannot move. Therefore, the piezoelectric ceramics 34 cannot be started to start a fire extinguishing agent, and the limiting screw of the handle 10 is clamped in the chute 39 while the limiting elastic sheet is clamped in the limiting groove of the handle 10. In use, the handle 10 is pulled out first for operation; subsequently, the safety pin 37 is pulled out and the push button 33 is pressed so that the piezoelectric ceramics 34 is started by the push button 33 to ignite an explosive in the cartridge. A generated hot aerosol is cooled by a chemical coolant and a cellular ceramic body, and simultaneously, the coolant undergoes some chemical and physical changes, and the hot aerosol is ejected through the spout of the grain to extinguish a fire.

What is claimed is:

1. A portable fire extinguisher, comprising a housing and a cartridge arranged within the housing, wherein a bottom of the cartridge is fixedly connected to the housing via a fastening device;

a top end of the cartridge is provided with an explosion venting device; the explosion venting device comprises a frictional layer, a connection rod, a connection rod guiding unit and a connection rod limiting device;

the connection rod is connected with the cartridge cover;

the frictional layer is provided between the connection rod and an outer wall of the cartridge; when the connection rod is guided by the connection rod guiding unit to displace along a direction of a hot air stream ejected by the cartridge, the frictional layer provides a frictional resistance and a buffering force for the connection rod;

the connection rod guiding unit is a device capable of providing a guiding function for the connection rod when the same is moving;

the connection rod limiting device is a device capable of limiting the connection rod when an extremity of the connection rod reaches a spout of the cartridge.

2. The portable fire extinguisher according to claim 1, wherein the fastening device includes a screw provided at the bottom of the cartridge, a nut matched with the screw, and a rotation-stopping body provided at the bottom of the housing and capable of preventing the screw from rotating.

3. The portable fire extinguisher according to claim 1, wherein the fastening device is a screw running through the bottom of the housing to fixedly connect the housing with the bottom of the cartridge.

4. The portable fire extinguisher according to claim 1, wherein the connection rod guiding unit is a guiding ring fixedly connected with the connection rod, or is a guiding groove provided on the outer wall of the cartridge and capable of enabling the connection rod to move axially along the guiding groove; the connection rod limiting device comprises a flanging fixedly connected with a jet end of the cartridge, and a clamping claw for fixing the connection rod; an elastic body is arranged between the flanging and the connection rod guiding unit, or is arranged on a side surface of the flanging.

5. The portable fire extinguisher according to claim 1, wherein the housing comprises a top cover; the top cover comprises a top cover body and a clamping wall fixedly connected thereto; the clamping wall is arranged at an inner side of the top cover body and an extremity of the clamping wall is provided with a clamping hook, and a cavity is reserved between the clamping hook and the top cover body; a fixture block is arranged in the cavity between the clamping wall and the top cover body.

6. The portable fire extinguisher according to claim 1, wherein the bottom of the housing is provided with a base; a handle and an extension and retraction control device are provided on the base; extension and retraction of the handle are implemented through the extension and retraction control device.

7. The portable fire extinguisher according to claim 6, wherein the extension and retraction control device comprises a locating groove arranged on the base and capable of enabling the handle to slide along the locating groove, and a limiting device capable of limiting the sliding of the handle.

8. The portable fire extinguisher according to claim 7, wherein the limiting device comprises a limiting elastic sheet, a limiting screw and a limiting groove; the limiting elastic sheet is arranged in the locating groove; one side surface of the handle is provided with the limiting screw clamped with the base and the other side surface of the handle (10) is provided with the limiting groove for making the limiting elastic sheet locked; a bottom cover of the base is provided thereon with a chute capable of enabling the limiting screw to slide along the chute and capable of limiting the limiting screw.

9. The portable fire extinguisher according to claim 8, wherein the handle comprises a curved bar and a holder; one end of the curved bar is arranged in the locating groove and capable of sliding along the locating groove; the other end of the curved bar is provided with the holder.

10. The portable fire extinguisher according to claim 9, wherein corresponding cavities are arranged on the curved bar and the holder; a push button and piezoelectric ceramics are arranged in the holder in turn; one end of the push button extends outside the holder and the other end is provided with a pin hole; an elastic clamping claw and a convex ring are arranged on the pin hole; the outer wall of the handle is provided with a safety pin; a side wall of one end of the safety pin is provided with a concave ring locked with the convex ring and having an extremity extending into the pin hole; the other end of the safety pin is provided with a pull ring.

11. The portable fire extinguisher according to claim 9, wherein corresponding cavities are arranged on the curved bar and the holder; a push button and a piezoelectric ceramics are arranged in the holder in turn; one end of the push button extends outside the holder and the other end is provided with a pin hole; a limiting ring is arranged outside the pin hole; an outer wall of the holder is provided with a safety pin; the safety pin comprises a connection part and a clamping head connected to the lower end of the connection part; the clamping head comprises one or more first elastic sheets, and a second elastic sheet connected to extremity of the first elastic sheet and forming included angle with the first elastic sheet; the first elastic sheets and the second elastic sheet are respectively provided with degrees of freedom; an extremity of the second elastic sheet extends outside the pin hole and is limited through the limiting ring; the upper end of the connection part is provided with a pull ring.

12. The portable fire extinguisher according to claim 2, wherein the bottom of the housing is provided with a base; a handle and an extension and retraction control device are provided on the base; extension and retraction of the handle are implemented through the extension and retraction control device.

13. The portable fire extinguisher according to claim 3, wherein the bottom of the housing is provided with a base; a handle and an extension and retraction control device are provided on the base; extension and retraction of the handle are implemented through the extension and retraction control device.

14. The portable fire extinguisher according to claim 1, wherein the bottom of the housing is provided with a base; a handle and an extension and retraction control device are provided on the base; extension and retraction of the handle are implemented through the extension and retraction control device.

15. The portable fire extinguisher according to claim 4, wherein the bottom of the housing is provided with a base; a handle and an extension and retraction control device are provided on the base; extension and retraction of the handle are implemented through the extension and retraction control device.

16. The portable fire extinguisher according to claim 5, wherein the bottom of the housing is provided with a base; a handle and an extension and retraction control device are provided on the base; extension and retraction of the handle are implemented through the extension and retraction control device.

* * * * *